US005601266A

United States Patent [19]

Fleming, III

[11] Patent Number: 5,601,266

[45] **Date of Patent: * Feb. 11, 1997**

[54] MOUNTING BRACKET FOR WALL PANEL LOCKS

[76] Inventor: Joseph C. Fleming, III, 17301 Edwards Rd., Cerritos, Calif. 90701

[ * ] Notice: The term of this patent shall not extend beyond the expiration date of Pat. No. 5,480,117.

[21] Appl. No.: 522,700

[22] Filed: Sep. 1, 1995

Related U.S. Application Data

[63] Continuation of Ser. No. 234,047, Apr. 28, 1994, Pat. No. 5,480,117.

[51] Int. Cl.[6] ..... A47F 5/08

[52] U.S. Cl. ..... 248/231.9

[58] Field of Search ..... 248/231.9, 205.1, 248/220.2, 224.4, 225.1, 297.2; 52/584.1, 127.7, 128.2, 127.8, 127.9, 127.6; 403/408.1, 407.1, 405.1, 384; 292/DIG. 53, DIG. 54, DIG. 60; 70/451, 466

[56] References Cited

U.S. PATENT DOCUMENTS 1,470,858 10/1923 Maxwell .
2,562,344 7/1951 Tranas .
2,933,007 4/1960 Healy .
3,026,704 3/1962 Baker .
3,815,467 6/1974 Fischer .
3,868,800 3/1975 Peterson .
4,586,843 5/1986 Heng et al. .
4,753,559 6/1988 Pentesco .
4,930,738 6/1990 Lombardo .
4,942,713 7/1990 Jackson .
4,951,980 8/1990 Wetzel .
5,303,892 4/1994 Minder et al. .
5,355,678 10/1994 Beitner .

*Primary Examiner*—David M. Purol
*Attorney, Agent, or Firm*—Knobbe, Martens, Olson & Bear, LLP

[57] ABSTRACT

A bracket for mounting a rotary lock member in the frame of a panel is provided. The bracket is a preferably U-shaped body having a base and two legs extending therefrom. The inner dimension of the bracket is chosen to allow insertion of a rotary lock member therein. Panel engaging steps and protrusions are located on the outside surface of each leg for engaging the frame material. The legs of the bracket are biased inwardly towards one another, such that when a locking member is inserted therein, the legs are pressed outwardly, driving the protrusions into the frame material. A number of bores are located in the bracket to allow supplemental locking members to lock the bracket to the frame.

10 Claims, 6 Drawing Sheets

MOUNTING BRACKET FOR WALL PANEL LOCKS

RELATED PATENT APPLICATIONS

This application is a continuation of U.S. patent application Ser. No. 08/234,047 filed Apr. 28, 1994 now U.S. Pat. No. 5,480,117.

FIELD OF THE INVENTION

The present invention relates to a mounting bracket for use in mounting lock members into wall panels. More particularly, the invention relates to a primarily U-shaped mounting bracket which can be installed into the frame of a wall panel, and into which a locking member can be inserted for anchoring the locking member to the panel.

BACKGROUND OF THE INVENTION

It is often necessary to create temporary walls in large, open spaces, to divide the space into smaller areas. Such a scenario is very typical in large, open office buildings and at convention halls.

Because these walls are temporary, it is desirable that the walls be designed for easy assembly and disassembly. Therefore, these walls often comprise individual wall panels which can be connected to and disconnected from, one another. Each panel typically is of a size which allows for easily storage and transport, but is large enough that not too excessive a number of panels is necessary to create a wall. Such panels are therefore typically of a size of 4 feet wide by 8 feet tall, although the panels can take on any variety of shapes and sizes depending upon the application.

In order to reduce the weight of each wall panel, which allows transport, assembly and disassembly to be accomplished with ease, and to reduce the cost of the materials associated with creation of the panels, each panel typically comprises an inner frame onto which a thin sheet of material is mounted (See FIG. 3). The frame acts as the support structure for the panel, and the sheet material acts as the "wall."

In most instances, the frame comprises assembled thin wood strips. These frame members often are 1" thick by 2" wide wood material. This material provides sufficient support for the sheet material, but is also of a light weight. Construction of a panel comprises assembling the frame members into a typical rectangular or square shape, and then covering the frame with sheet material.

In order to connect the wall panels to one another, a locking mechanism is employed. This locking mechanism is capable of supplying large engaging forces to secure each individual wall panel to the other panels in a manner which provides structural rigidity.

The locking means most often employed in locking such panels together is an interengaging rotary lock system. Such systems typically comprise a first male locking member having an outwardly rotatable engaging member, and a second female locking member which can accept the engaging member. Each member is mounted in a recess in the peripheral edge of the panel, such that when the members are engaged, the adjacent panels form a uniform planar surface (see FIG. 3). Such locks are often called "rotary-action locks." One such lock system can be obtained from the SouthCo-Simmons Company.

These lock systems are installed such that a male lock portion is located in the frame of one wall panel, and a corresponding female lock portion is located in the frame of the adjacent panel. Once the panels are aligned, the engaging member of the male portion of the lock is rotated such that it extends into the female portion of the lock. When fully engaged, the male and female lock members can pull adjacent wall panels together with a force of over 1500 pounds.

Unfortunately, no acceptable means has been devised for mounting the locking members in the wall panel frame in a simple and effective manner. In the first instance, the locking members must be firmly anchored to the wall frame, or the large locking forces will pull the locking members from the frame. Second, it is desirable that the locking members be installable after the panel has been assembled. It is also desirable for the locking members to be easily removable and interchangeable after the panel is assembled.

Prior to the present invention, no means existed which solved both of these problems. In fact, a great need has existed up until the present invention for means for solving these problems.

FIG. 1 illustrates one prior means for mounting a male locking member 10 in a frame member 12 of a wall panel. In this arrangement, holes are provided at the rear of the locking member for attachment to the frame. Unfortunately, because of the thinness of the wood frame, these holes are in a location which does not permit them to be used in attaching the lock member to the frame. Therefore, it has been typical to provide a wooden backup 14 to which the locking member is attached. The wooden backup is centered about the through hole in the frame member through which the locking member extends, and is attached to the frame member.

The wooden backup has the benefit that it can distribute the large pulling force of the lock about a wide area on the frame. On the other hand, the backup itself is quite costly and time consuming to make. Further, because the backup must be larger than the hole through which the locking member extends, the entire assembly must be attached to the inside of the frame member before the sheet material is placed on the frame.

In order to solve the problems associated with mounting of the locking member illustrated in FIG. 1, the system illustrated in FIG. 2 was developed. As can be seen, in this system, a locking member 10 similar to that shown in FIG. 1 is provided with a pair of attachment wings 16 located on each side of the locking member. When the locking member is placed into the hole in the frame 12, these wings abut against the inside surface of the frame member, and screws or other attachment devices can be inserted therethrough to attached the locking member to the frame.

While the system illustrating in FIG. 2 has the advantage of being cost effective in the sense that no extra backup need be used, the locking member must still be installed before the panel is assembled. Further, in either of the first two arrangements, once installed, it is nearly impossible to remove the locking member from the panel without breaking the frame or disassembling the panel, as is often necessary to interchange male and female lock members and the like.

Therefore, there remains a need for a means for attaching a locking member to the frame of a panel, which means allows the locking member to be firmly anchored to the frame of the panel, which allows the locking member to either be anchored to the panel before or after it is assembled, and which allows the locking member to be removed or interchanged after creation of the panel.

SUMMARY OF THE INVENTION

The present invention preferably comprises a bracket for mounting in the frame of a wall panel. The bracket is designed to accept a rotary lock member, such that location of the lock member in the bracket anchors the lock member to the frame.

The bracket of the present invention can easily be installed in the frame of the panel both before the panel has been assembled, and after. Further, the bracket allows the locking member to be attached to or removed from the panel at any time.

The bracket of the present invention eliminates the necessity for a costly backup unit, and is itself cost-effective and lightweight. The bracket of the present invention can be installed in the thinnest of frame materials and eliminates the need for pre-sizing of frame materials or adjusting the size of backup blocks to fit the frame size. Yet, the present invention still provides a secure anchor for the locking member attached thereto.

In the preferred embodiment, the bracket preferably comprises a primarily U-shaped member having a base with two ends, and a leg extending from each end of the base. The inside perimeter of the bracket is preferably chosen to match, as closely as possible, the outer dimension of the rotary lock member which is to be inserted therein.

Frame engaging means, preferably in the form of frictional engaging means, are located on the outer surface of each leg, for engaging the frame material into which the bracket is inserted. In a preferred form, the engaging means comprise a number of protrusions in the form of spikes extending outwardly from the outer surface of each leg. Preferably, such means also includes a number of steps located on the outer surface of each leg, such that the total height dimension of the bracket is greater at a point along the legs than at their connection to the base. Lastly, each of the legs is biased or bowed inwardly towards one another by a small distance.

In operation, the bracket is first anchored in a frame member of a panel. This can advantageously be accomplished both before or after the panel has been assembled. The bracket is preferably anchored in the frame by driving it into a bore or hole made in the frame.

As the bracket is driven into a correctly dimensioned hole, the increasing height dimension of the bracket causes an interference fit between the bracket and frame which acts to lock the bracket in the frame. Further, the protrusions on the legs act to gouge and engaged the frame material. Placement of screws or other attaching means through bores or holes in the bracket act to further anchor the bracket, and act to drive the legs of the bracket outwardly, further causing the protrusions to engage the frame material.

Next, a locking member is simply anchored to the frame by placing it inside the bracket in the frame. Most advantageously, when the locking member is placed in the bracket, the legs of the bracket are pressed outwardly, further causing the protrusions on the legs to further engage the frame material. The locking member may then be anchored securely to the bracket through use of bolts passed through the back of the locking member into bores in the base of the bracket.

Further objects, features, and advantages of the present invention will become apparent from the detailed description of the drawings which follows, when considered with the attached figures.

DETAILED DESCRIPTION OF THE PREFERRED EMBODIMENT

Figure 4:
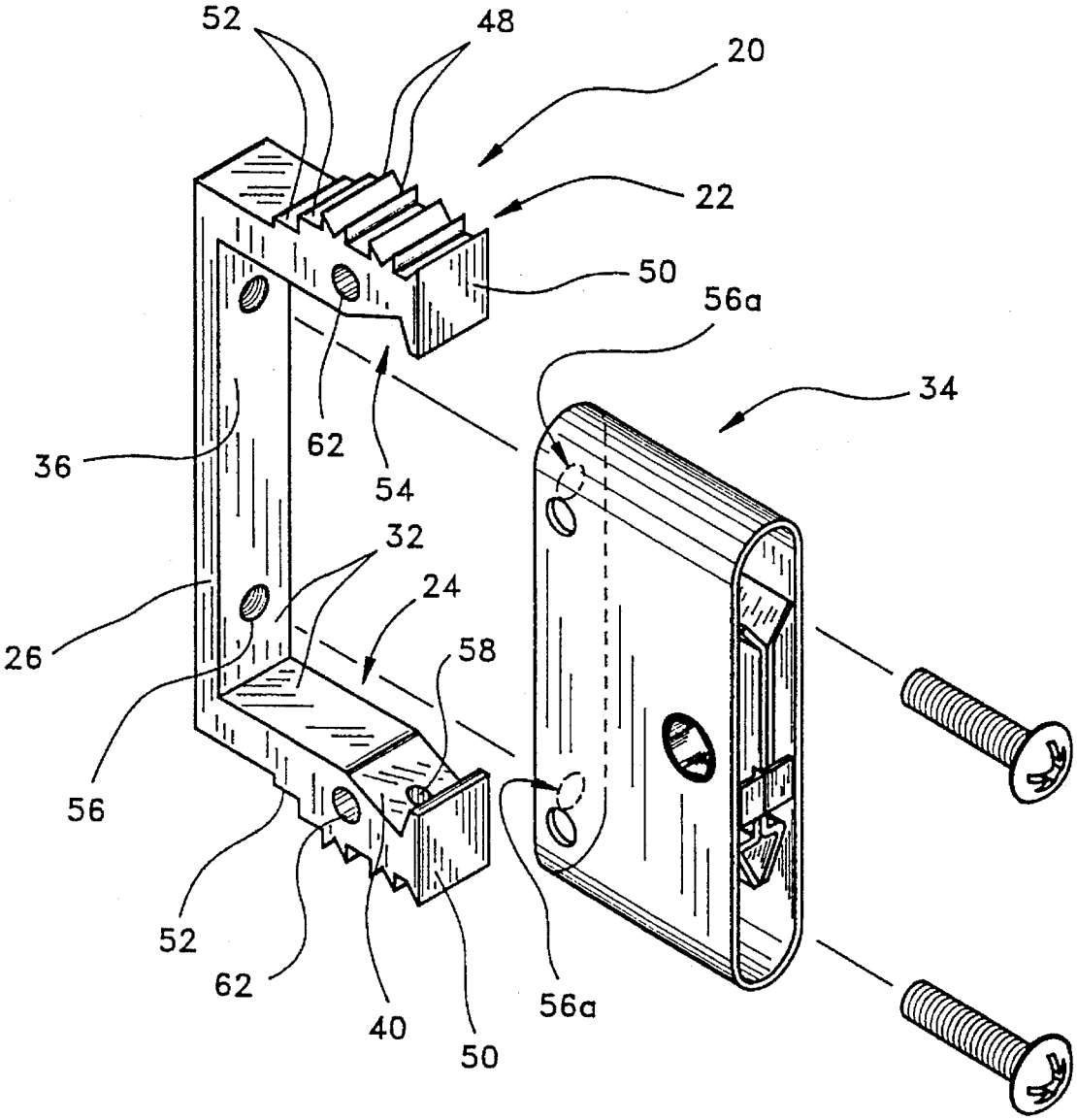
FIG. 4 is a perspective view of a mounting bracket of the present invention for location therein of a locking member.
Figure 5:
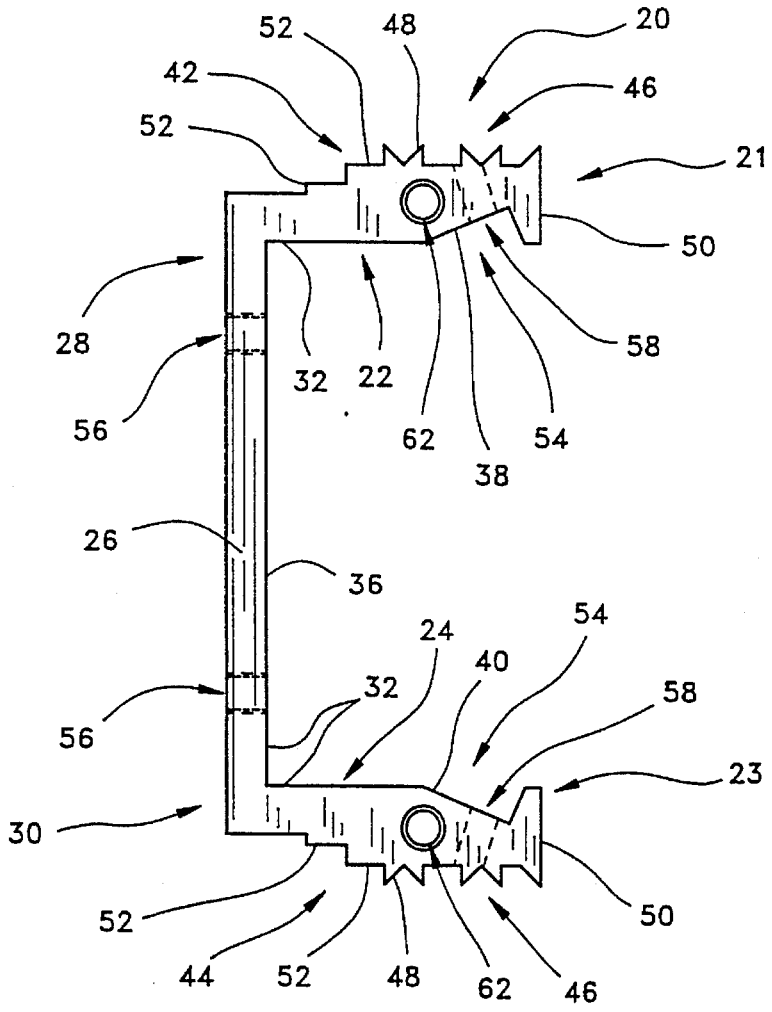
FIG. 5 is a side view of the mounting bracket of FIG. 4.
Figure 6:
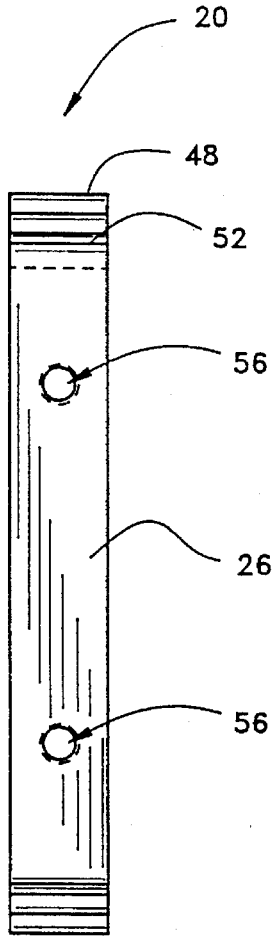
FIG. 6 is an end view of the mounting bracket of FIG. 4.

Illustrated in FIGS. 4–6 is a bracket 20 in accordance with the present invention. In general, the bracket 20 is preferably a "U" shaped member for acceptance therein of a rotary lock member 34. The bracket 20 thus preferably comprises a base 26 having a first end 28 and a second end 30. A first leg 22 is preferably located at, and extends from, the first end 28 of the base 26. A second leg 24 is preferably located at, and extends from, the second end 30 of the base 26.

It is preferred that the bracket 20 be formed from a single piece of material, with the legs 22, 24 and base 26 formed as a contiguous piece. It is possible, of course, for the bracket 20 to comprise one or more assembled pieces of material. Preferably, in order that the bracket 20 durable, light-weight, and corrosion-resistant, the bracket 20 is made of aluminum. Other materials, as well known in the art, may be used. Such materials may include, but not be limited to, steel and iron.

The legs 22, 24 and the base 26 are constructed to provide an inside perimeter surface 32 which is sized to allow the insertion of the rotary lock member 34 therein. Thus, the inside surface 36 of the base 26 preferably has a length slightly longer than the height of the rotary lock member 34. For male rotary lock members 34 manufactured by SouthCo Simmons Company, the inside surface 36 has a length of about 8.5 cm. Further, each leg 22, 24 preferably has a length such that an inner surface 38, 40 thereof is equal to or greater than the depth of-the rotary lock member 34. For male rotary lock members 34 manufactured by SouthCo Simmons Company, the legs 22, 24 preferably extend a distance of about 4.5 cm from the inside surface 36 of the base 26, while for female lock members this distance is about 3 cm.

Most preferably, female lock members may be placed into "male-sized" brackets, through use of a spacer 66 (see FIG. 7) located against the base of the bracket 20. This spacer may be made of wood, aluminum, plastic or the like. Advantageously, use of such a spacer 66 allows the placement of a standard male-sized bracket into all frames, which then allows male and female lock members to be easily interchanged without the need to replace the bracket itself.

Each leg 22, 24 preferably extends from the base 26 at an angle of slightly less than 90°, or in other words, the legs 22, 24 are preferably not connected to the base 26 in a perpendicular fashion. In particular, it is desired that each leg 22, 24 bow or be biased inwardly at an outer end 21, 23 by a distance of about 0.5 cm (1/32") from a line which runs perpendicular to the base 26. It is, of course, possible to have the legs 22, 24 extend parallel to one another, and be perpendicular to the base. However, as described in detail below, this mounting is not preferred, as it does not aid in engaging frictional engaging means which lock the bracket to the panel.

In order to reduce the material cost and total weight of the bracket 20, and in order that the bracket 20 be insertable into a narrow wooden frame member 64 of a wall panel, the width of the bracket 20 is preferably very narrow or thin. In fact, it is desired that the bracket 20 only be as wide as the rotary lock member 34 which is inserted therein. For a standard SouthCo Simmons Company lock member 34, the bracket 20 thus preferably has a width of about 1.5 cm. The bracket 20 can be narrower than the lock, however, as long as it will support the necessary attachment of the lock member to the bracket.

The outer surface 42, 44 of each leg 22, 24 preferably has a frame member engaging means 46 located thereon. In a preferred embodiment the engaging means 46 are frictional engaging means, and preferably comprise at least one protrusion on at least one leg 22, 24. Preferably the protrusion is an upwardly extending spike 48. It is preferred that there be at least 5 of such spikes 48 located on the outer surface 42, 44 of each leg 22, 24, although there may be as few as 1 or 2, and as many as 7 or more. Further, While the engaging means 46 are preferably spikes 48, the engaging means could, of course, take a variety of configurations. For example, the means 46 could comprise arched teeth or the many points of a knurled surface. In any case, the engaging mean 46 should serve the purpose of engaging the frame member.

As illustrated in the preferred embodiment, however, each spike 48 preferably extends outwardly from its corresponding leg 22, 24 by approximately 0–5 mm or more, and one most preferably about 3 mm high. Further, it is desired that the spikes 48 extend across the entire width of the leg 22, 24, essentially in the form of a ridge, although it is possible for the spikes 48 to be shorter than the width of the leg 22, 24.

Preferably as part of (although it is possible for it to be in substitution to) the engagement means 46 described above, the outer surface 42, 44 of each leg 22, 24 also preferably includes a number of steps 52. Each of these steps 52 has the effect of increasing the total exterior height dimension of the bracket 20, as viewed from the base 26 to the ends 21, 23 of each leg 22, 24. Most preferably, these steps 52 increase the height dimension of the bracket 20 along each leg 22, 24 by about 2–10 mm, and most preferably by about 4–5 mm over the height dimension of the bracket 20 at the base 26.

This total increase in height dimension may be accomplished by having two steps 52 located on each leg 22, 24 as illustrated. Alternately, there may only be one large step, or a number of smaller steps located on each leg 22, 24.

The steps 52 are most preferably located on the bracket 20 in order to facilitate placement of the bracket 20 in a routed slot in the frame of the panel, as described in more detail later. In particular, the steps 52 act to aid in alignment of the bracket 20 when it is inserted into a routed slot, and also act to chisel away for fitting a portion of the frame material located at the radius of the routed slot.

A notch 54 is located in each leg 22, 24 on its inner surface 38, 40. The notch 54 is preferably located very near the end 21, 23 of each leg 22, 24. Preferably, the notch 54 comprises a slightly inwardly tapered section of the leg 22, 24 near the end 21, 23 of each leg 22, 24. A bore 58 is also located in the notch 54 located in each leg 22, 24. This bore 58 preferably runs perpendicular to the inner surface 38, 40 of each leg 22, 24 at the notch 54, to permit a screw or nail inserted therein to be placed flush with the inner surface 38, 40 of the legs 22, 24. These bores 58 are sized to allow passage therethrough of a screw, nail or similar attachment item.

As is now apparent, the depth of the notch 54 in each legs 22, 24 is chosen to prevent the screw, nail, or similar item inserted through bore 58 from protruding into the space in the bracket 20 which is to be occupied by the locking member 34. Further, the angle of the notch 54, and the bore 58 therethrough, is chosen to facilitate the easy insertion and installation of a screw, nail, or similar item through the bore 58 by a conventional screwgun or screwdriver aimed perpendicular to the bore 58.

Located on the end 21, 23 of each leg 22, 24 is an engaging surface 50. The engaging surface 50 is preferably flat, such that when the bracket 20 is installed, the engaging surfaces 50 at the ends 21, 23 of the legs 22, 24 are flush with the outer surface of a frame member 64 into which it is inserted. Further, the surface area of the surface 50 is large enough to permit use of a hammer or other item to drive the bracket 20 into the frame member 64, as described in more detail below.

At least one bore 56 is located in the base 26. Preferably, there are two bores 56, each of which are located in a position such that they are aligned with corresponding bores **56*a* in the rotary lock member 34, when the lock member is inserted therein. Each of these bores 56 is preferably threaded, in order that a bolt or other device may be used to securely connect the rotary lock member 34 to the bracket 20. It is, of course, possible to connect the lock member 34 to the bracket 20** in a variety of ways, as will be apparent to one skilled in the art.

Another bore 62 is preferably located on each leg 22, 24, passing through each leg 22, 24 perpendicular thereto. This bore 62 is also preferably sized to allow passage therethrough of a screw, nail, or similar attachment item. The bore 62 may optionally be used to further anchor the bracket 20 in the frame member 64. These bores 62 are most conveniently used when violation of the face surface of the panel is not important.

Figure 1:
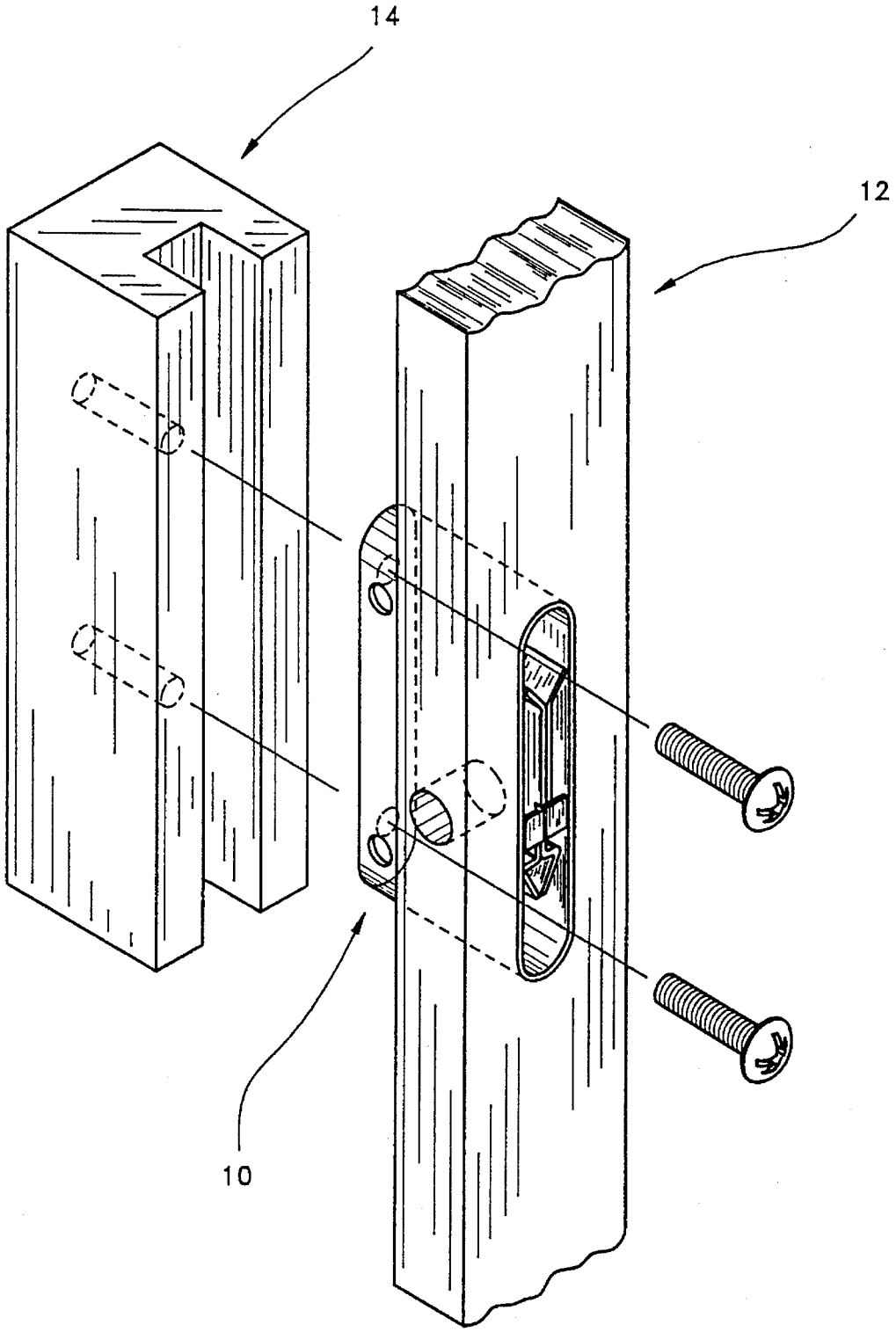
FIG. 1 (PRIOR ART)
FIG. 1 is a perspective view of a prior art locking member for mounting in a frame member of a wall panel using a conventional back-up member.
Figure 2:
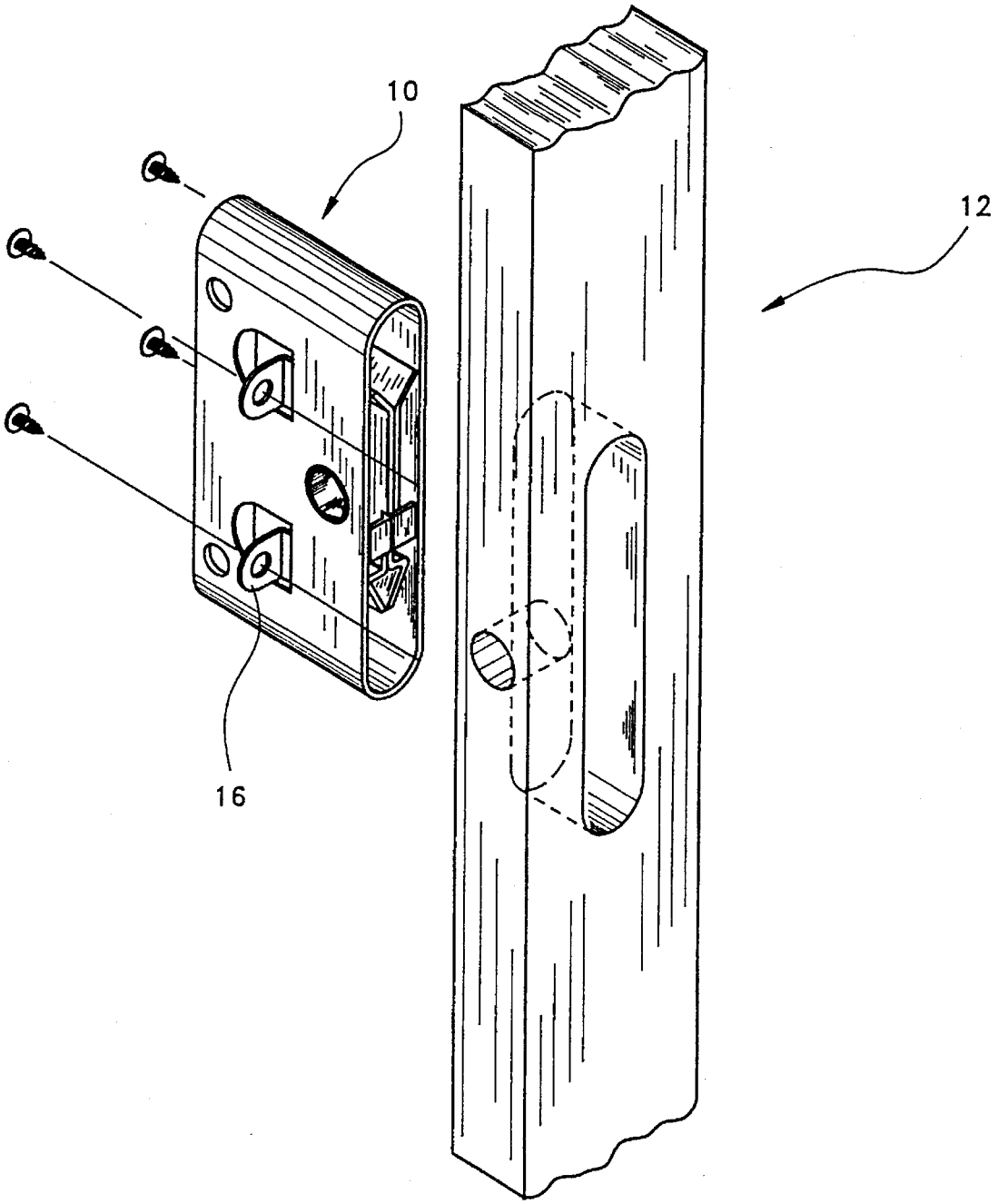
FIG. 2 (PRIOR ART)
FIG. 2 is a perspective view of a prior art locking member for mounting in a frame member of a wall panel, where the mounting means comprise wings located on the locking member.
Figure 3:
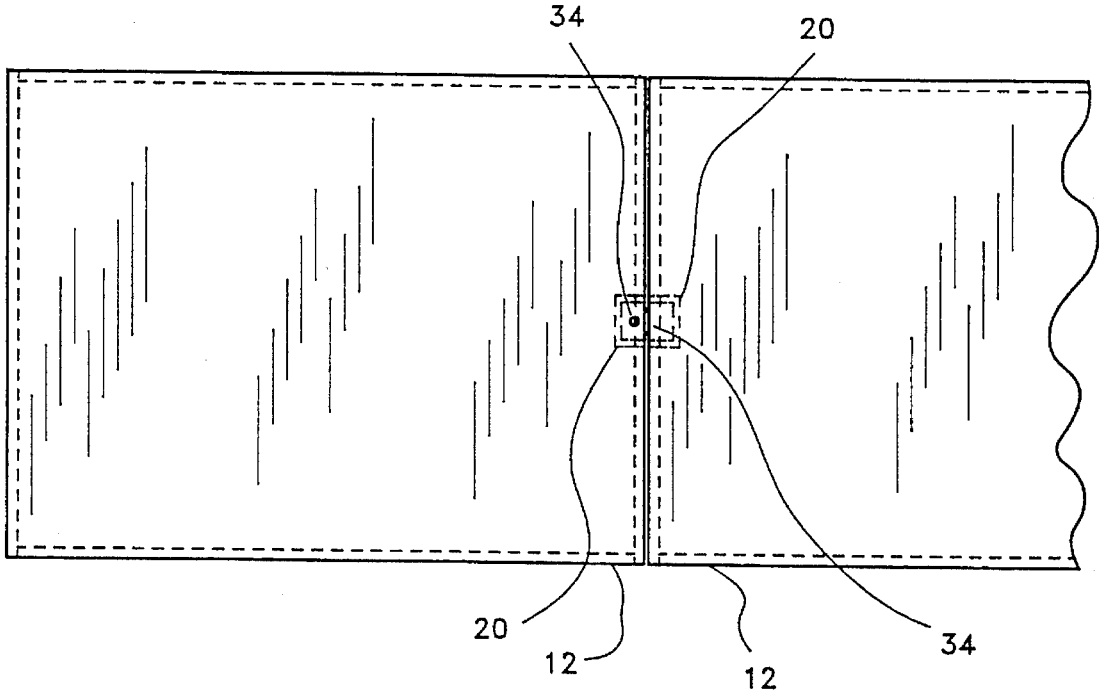
FIG. 3 illustrates two wall panel portions as connected with locking members.

Use of bracket 20 in mounting a rotary lock member 34 will now be described in conjunction with FIGS. 4 & 7. In operation, a bracket 20 is first installed into a frame member 64. This can advantageously be accomplished either before panelling is placed over the frame members 64, or after. In either case, an elongated slot or recess similar to, but slightly longer than the one illustrated in FIG. 2, is made in the center of the frame member 64 at the desired location along the length of the frame member 64. This slot should be of a size such that the base 26 of the bracket 20 just fits into the slot. In other words, the width of the slot should be approximately the same as the width or thickness of the bracket 20, and the height of the slot should be about the same, or slightly less than, the distance between the ends 28,30 of the base 26. It has been found that having a slot having rounded ends is most advantageous.

The base 26 of the bracket 20 is aligned with the slot, and a hammer or similar other driving device is used 6o drive the bracket 20 into the frame member 64. This is most preferably accomplished by hitting the engaging surfaces 50 on each end 21, 23 of each leg 22, 24 in alternating fashion.

This driving step continues until the engaging surfaces 50 on of each leg 22, 24 are flush with the outer surface of the frame member 64, or even up to or over about ⅛" below the outer surface of the frame.

As the bracket 20 is driven into the frame member 64, the increasing height of the bracket 20, as caused by the steps 52, creates a tighter and tighter interference fit between the bracket 20 and the frame member 64. Most importantly, as the bracket 20 is driven into the frame member 64, the engaging means 46 on each leg 22, 24 also gouge into the frame material, further locking the bracket 20 into the frame member 64.

Once the bracket 20 is inserted into the frame member 64, it may further be anchored to the member through use of screws or nails which are passed through bores 58 and/or 62. While is it not necessary to use these supplemental anchor means, it is preferable, as it adds to the bond between the bracket 20 and the frame member 64, further reducing the possibility that the bracket will be pulled from the frame member 64. These additional anchor means also act to further drive the engagement means 46 against the frame material, further anchoring the bracket 20 as well. It is again noted that the use of these additional anchor means is possible even if when the panel is already assembled, as the location of the bores 58, 62 in the bracket 20 allows them to be accessed from the front of the bracket 20 through the slot.

Next, a rotary lock member 34 is placed into the bracket 20. It is noted that because of the typical difference in depth between male and female lock members, a male lock member 34*a* should be inserted into a corresponding sized bracket 20, as described above, and a female lock member 34*b* into a corresponding sized bracket 20. Most preferably, and as shown in FIG. 7, the female lock member 34*b* is placed into the same bracket 20 as a male lock member 34*a*, through use of a spacer 66 and longer attaching screws.

As stated above, the dimensions of the inside perimeter 32 of the bracket 20 are preferably the same as the outside dimensions of the lock member 34, except that the legs 22, 24 of the bracket 20 are bowed slightly inwardly. Therefore, as the lock member 34 is inserted into the bracket 20, the lock member 34 must be driven between the legs 22, 24, pressing them outwardly, until the lock member 34 is fully inserted into the bracket 20. Advantageously, this process, which causes the legs 22, 24 to move outwardly, further presses the engaging means 46 located on the outer surface 42, 44 of each leg 22, 24 deeper into the frame material 64.

Once the lock member 34 has been inserted into the bracket 20, it is anchored to the bracket 20 through use of screws, bolts, or other means which are passed through the bores 56, 56*a* in the lock member 34 and bracket 20.

Figure 7:
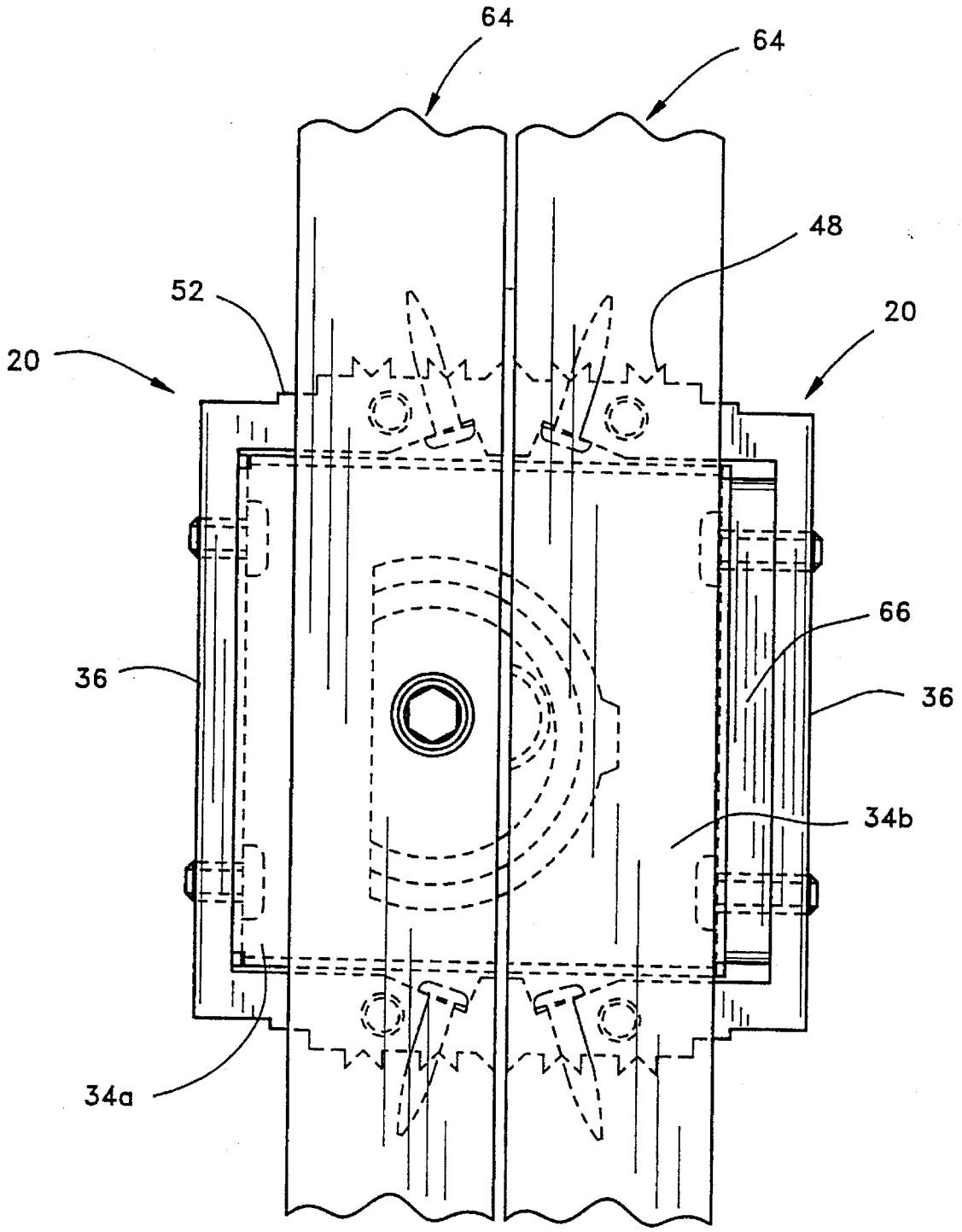
FIG. 7 is a side view illustrating engaging locking members located in mounting brackets of the present invention mounted in the frames of adjacent wall panels.

A similar procedure is used to prepare the other mating half of the rotary lock in another panel, such that the two rotary lock members 34 can be locked together when the two panels are placed side-by-side, as illustrated in FIG. 7. At that time, the male rotary lock member 34*a* is engaged with a standard lock actuating wrench, and the rotary locking bolt is extended into the female half of the lock, causing the two halves to join. At that time, the panels are securely joined to one another. Of course, similar panels may be joined together in succession. Further, although only one lock has been described for use in locking adjacent panels, it is possible to use more than one set of locks to join adjacent panels.

As can be seen, the present invention allows a rotary lock member to be installed into a panel, regardless of whether the panel is already assembled. Thus, panels already in use can easily be retrofitted with rotary locks, without the need to disassemble the panel to get a mounting bracket inside. Further, the bracket of the present invention does not require any additional back-up materials, but instead easily mounts in the thinnest of frame members. The bracket of the present invention also engages the frame member with a force which prevents the rotary lock member therein from being dislodged from the frame when the lock members are engaged.

It will be understood that the above described arrangements of apparatus and the method therefrom are merely illustrative of applications of the principles of this invention and many other embodiments and modifications may be made without departing from the spirit and scope of the invention as defined in the claims.

What is claimed is:

1. A member for use in anchoring a locking member to a frame of a panel, comprising:

a primarily U-shaped bracket including an elongate base having two ends and a leg extending from each end of said base, said legs having an inner and an outer surface, said base and legs defining a substantially rectangular inner bracket perimeter for acceptance of a rectangular locking member therein, said bracket further including frictional engagement means for securing the bracket to the frame, said frictional engagement means comprising a surface irregularity along a portion of said outer surface of at least one of the legs.

2. The member of claim 1 further including means for connecting said locking member to said bracket.

3. The member of claim 1, wherein said frictional engagement means comprises a portion of at least one of said legs extending outwardly to form a protrusion.

4. The member of claim 3, wherein said protrusion comprises a spike.

5. The member of claim 3, wherein said protrusion comprises a step.

6. The member of claim 1, wherein surface irregularity comprises at least one step and at least one outwardly extending spike on each leg.

7. A bracket for use in anchoring a locking member to a frame of a panel, comprising:

a primarily U-shaped bracket including an elongate base having two ends and a leg extending from each end of said base, said legs having an inner and an outer surface, said base and legs defining a substantially rectangular inner bracket perimeter for acceptance of a rectangular locking member therein, said legs biased inwardly towards one another.

8. The bracket of claim 7, further including at least one recess positioned on the inner surface of each of said legs, and wherein a bore is located in each recess, said bore passing through said leg.

9. The bracket of claim 8, wherein said recess comprises a notch located in said inner surface of said leg.

10. The bracket of claim 7, wherein said bracket includes friction engagement means for fastening said bracket to a frame.

* * * * *